US008110821B2

(12) United States Patent
Lemer

(10) Patent No.: US 8,110,821 B2
(45) Date of Patent: Feb. 7, 2012

(54) SHIELDED CONTAINER STRUCTURE FOR THE TRANSPORT AND STORAGE OF A RADIOACTIVE SOURCE FOR MEDICAL USE

(75) Inventor: Pierre-Marie Lemer, Nantes (FR)

(73) Assignee: Lemer Protection Anti-X Par Abreviation Societe Lemer Pax, Carquefou (FR)

( * ) Notice: Subject to any disclaimer, the term of this patent is extended or adjusted under 35 U.S.C. 154(b) by 350 days.

(21) Appl. No.: 12/443,321

(22) PCT Filed: Sep. 28, 2007

(86) PCT No.: PCT/FR2007/052046

§ 371 (c)(1),
(2), (4) Date: Mar. 27, 2009

(87) PCT Pub. No.: WO2008/040904

PCT Pub. Date: Oct. 4, 2008

(65) Prior Publication Data

US 2010/0032591 A1 Feb. 11, 2010

(30) Foreign Application Priority Data

Sep. 29, 2006 (FR) ..... 06 08587

(51) Int. Cl.
*G21F 5/015* (2006.01)
*G21F 5/12* (2006.01)
*G21F 5/14* (2006.01)

(52) U.S. Cl. ..... 250/507.1; 250/506.1; 250/505.1

(58) Field of Classification Search ..... 250/505.1, 250/506.1, 507.1, 515.1, 519.1
See application file for complete search history.

(56) References Cited

U.S. PATENT DOCUMENTS 5,562,592 A * 10/1996 Curiel ..... 588/259
5,831,271 A * 11/1998 Okano et al. ..... 250/432 PD
5,871,113 A * 2/1999 Conway et al. ..... 220/210
6,812,475 B1 * 11/2004 Huang ..... 250/507.1
2005/0107698 A1 5/2005 Powers et al.

OTHER PUBLICATIONS

International Search Report dated. Mar. 17, 2008, from corresponding PCT application.

* cited by examiner

*Primary Examiner* — Robert Kim
*Assistant Examiner* — Nicole Ippolito Rausch
(74) *Attorney, Agent, or Firm* — Young & Thompson

(57) ABSTRACT

A container for transporting a receptacle (2) containing a radioactive substance for medical use. includes a shielded body made up of a belt of side walls connected to a base element and defining a top opening, and a shielded closing lid attachable to the top opening by locking elements shaped so as to be activated by a translational movement of the lid in the top opening, this "locking movement" taking place along the axis of the opening and towards the opposing base element. The lid is further equipped with elements for deactivating the locking elements to enable it to be separated from the container body. In one advantageous embodiment, the lid has a plurality of retractable projecting studs designed to fit by a snap-action type phenomenon into at least one complementary housing formed in the opening of the container body during the locking movement.

16 Claims, 5 Drawing Sheets

SHIELDED CONTAINER STRUCTURE FOR THE TRANSPORT AND STORAGE OF A RADIOACTIVE SOURCE FOR MEDICAL USE

The present invention relates to a novel shielded container structure made of radioprotective material, for the transport and storage of a radioactive source for medical use.

In certain medical specialties and particularly cancerology, a definite dose of a suitable radioactive substance is sometimes administered to a patient for purpose of diagnosis or treatment.

To comply with the standards for safety and protection against radiation, these radioactive substances have to be transported and stored in shielded containers, interesting in that they protect against radiation any person who may come nearby, such as patients, hospital staff, or people in charge with the transport of these substances, etc.

Very generally, today's containers are made up of a shielded body made of radioprotective material, provided with an opening for the introduction and extraction of the bottle containing the radioactive source.

A shielded lid, also made of radioprotective material, is used to close the container and block the radiations passing through the opening.

In certain containers, the lid is merely put on the opening of the shielded body without any particular locking means, which is of course a possible source of incident.

That is why, in the majority of cases, the lid is held in place on the container body by locking means (in particular, by screwing).

However, present locking means are complex to implement; moreover, the operator is forced to firmly hold the container body to activate or deactivate the locking means when putting or removing the lid.

During these closing/opening operations, the person that handles the lid and the container body is finally subjected to radioactive radiation which can be not insignificant.

To remedy these drawbacks, the applicant has developed a container in which the lid can be locked very simply and very quickly onto the container body, without the operator being forced to hold this container body in a firm manner and for a long time.

In accordance with the invention, such locking means are shaped so as to be activated by a translational movement of the lid in the opening of the container body, this being termed the "locking movement" and taking place along the axis of said opening and towards the base element of the container, and said lid being further equipped with means for deactivating said locking means, in order to enable said shielded lid to be separated from said container body.

In one advantageous embodiment, the lid is provided with a plurality of retractable projecting studs designed to fit by a snap-action type phenomenon into at least one complementary housing formed in the opening of the container body.

These projecting lugs are operable between two positions:

a locking position, in which they enter said housing by a snap-action type phenomenon during the locking translational movement, and a retracted position, actuated by the deactivation means and in which they are located outside the bulk of said housing, enabling the shielded lid to be dissociated from the container body.

Moreover, said projecting studs cooperate on the one hand with spring means shaped so as to tend to keep the former in their locking position, and on the other hand with a deactivation member controllable by an operator to operate said projecting studs to their retracted position.

In this embodiment, the studs are advantageously in the form of hooks hinged at one of their ends, and the other end of which projects inwardly so as to be able to cooperate with an annular groove opened outwardly and formed in the opening of the container body. The projecting hooks cooperate with the deactivation member that can be controlled by the operator so as to make the former pivot outwardly to the retracted position.

According to another characteristic, the deactivation member consists of one piece having an outwardly flared part forming a cam, said deactivation member being movable inside the lid between two positions:

a rest position, in which the hooks are in the locking position, and a deactivation position, obtained through an operator control action and in which said flared part pushes said hooks so as to make them pivot outwardly to the retracted position.

In this case, the lid is advantageously equipped with a handle whose operation by the operator ensures the displacement of the deactivation member so as to control the displacement of the protruding members between the unfolded and folded positions; alternatively, the deactivation member is operable to the deactivation position, corresponding to the retracted position of the hooks, through application by the operator of a magnetic field generated by means of a magnetic handle added on the lid.

Still in this case, the deactivation member is advantageously in the general form of a ring operable in an axial translational movement between the lower rest position and the upper deactivation position; said deactivation member being provided with an outwardly flared lower edge to form the operating cam acting on the hooks through pressing rollers, each of which is carried by one of said hooks, the latter being also connected to elastic return means in the form of a spring ring tending to keep them in the active locking position.

Still according to the invention, the container body is made up of a shielded inner part nested into an also-shielded outer part, these shielded parts being each made up of a belt of side walls connected to a base element. The inner part, on the side of the radioactive source, is made of radioprotective material having radioprotective characteristics higher than those of said outer part; the thickness of these inner and outer parts being a function of the required level of radioprotection.

In one advantageous embodiment, the container body comprises a tungsten inner part nested into a lead outer part; in this case, the closing lid locks onto the inner part, which has the advantage to be more resistant and less malleable than the lead.

According to an additional characteristic, the container body also comprises a peripheral shell made of a plastic material, covering the surface of the shielded outer part thereof.

Said plastic shell is advantageously made up of a belt of side walls, the lower edge of which is connected to a base element and the upper edge of which is extended by an upper return covering at least the upper edge of the shielded outer part; the base element and the lower edge of the belt of side walls of the plastic shell are provided with complementary structural means enabling them to be assembled by permanent or detachable nesting.

This plastic shell is interesting in that it is rather cheap, and thus able to be replaced when it is degraded; it also forms a protective envelop for the lead outer part of the container, the latter being relatively sensitive to physical attacks such as shocks or frictions.

The invention will be further illustrated, without being in any way limited, by the following description of two embodiments given only by way of example and shown in the attached drawings, in which.

Figure 1:
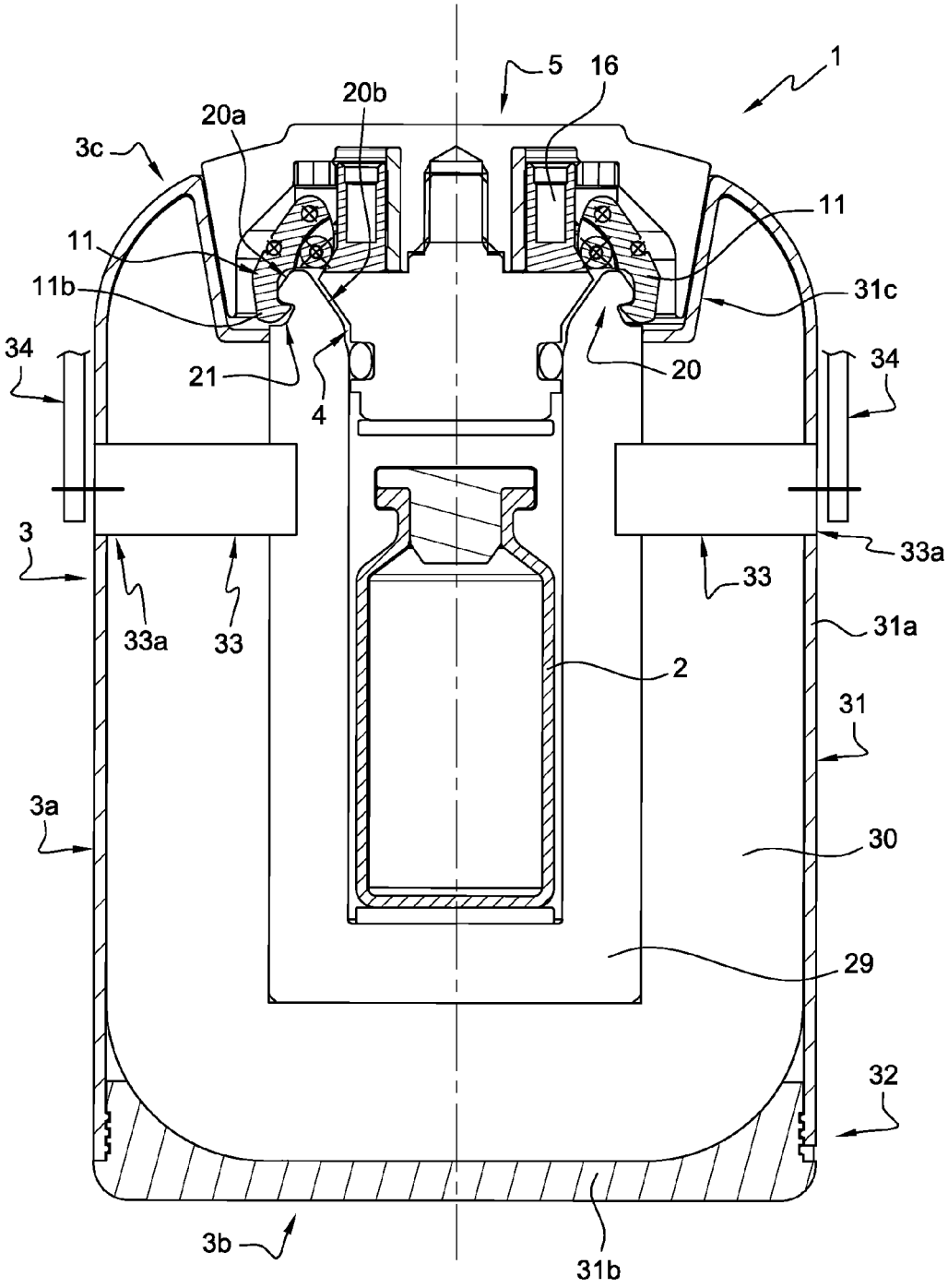
FIG. 1 is a cross-sectional view of a container according to the invention, comprising a container body closed by a lid of the type which is unlockable by means of a magnetic handle.
Figure 2:
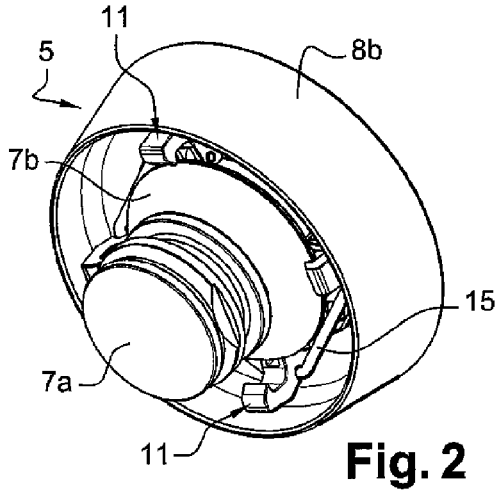
FIGS. 2 and 3 are overall views of the closing lid of FIG. 1, with perspective views from below and from above, respectively.
Figure 3:
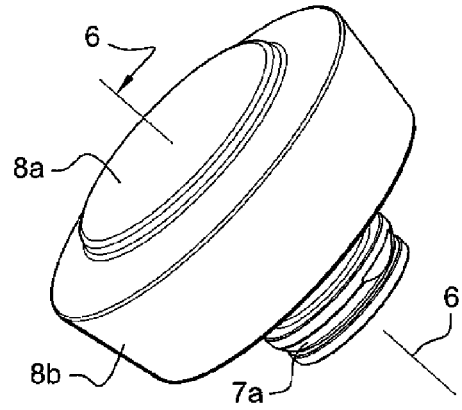
Figure 4:
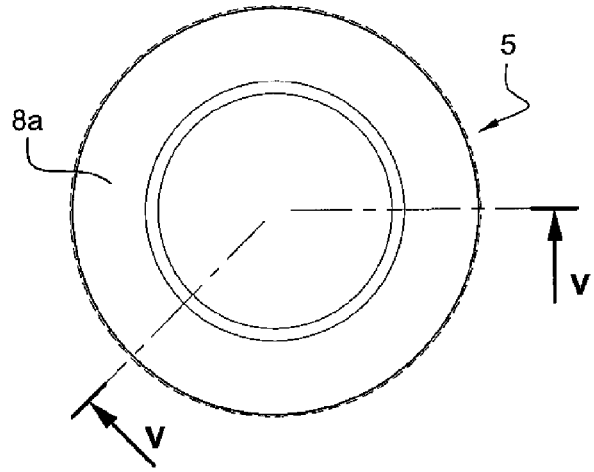
FIG. 4 is a top view of the closing lid of FIG. 1 to 3.

The shielded container 1, shown in a schematic cross-sectional view in FIG. 1, is adapted for the transport of a receptacle 2 containing a radioactive substance, for example for a medical use.

The container 1 comprises a cylindrical body 3 made of radioprotective materials (namely, the association of a layer of tungsten with a layer of lead). The container body 3 is made up of a cylindrical side wall 3*a* connected to a flat base element 3*b*; the upper edge 3*c* of said cylindrical wall 3*a* defines a circular top opening 4 that, in FIG. 1, is closed by a closing lid 5 also made of radioprotective material.

In accordance with the invention and as described in detail hereinafter, the closing lid 5 comprises means for locking it to the container body 3, shaped so as to be activated by a translational movement of the lid 5 in the opening 4, this being termed the "locking movement" and taking place along the axis of said opening 4 and towards the opposing base element 3*b*; said lid 5 being further equipped with means for deactivating the locking means thereof in order to enable said shielded lid 5 to be separated from said container body 3 (still by a translational movement).

In this case, the closing lid 5, shown isolated in FIGS. 2 to 5, is principally made of tungsten.

The lid 5 has a generally circular shape with a central axis 6; it comprises a main body 7 made up of a generally cylindrical lower part 7*a* and a generally tapered upper part 7*b*, topped with a head 8 made up of a circular central part 8*a*, the edge of which is extended by an annular skirt 8*b* extending opposite the main body 7 and remotely from the latter.

The lower part 7*a* of the main body 7 comprises an O-ring 7*c*, intended to ensure the tightness of the lid 5 once it is locked onto the container body 3.

The lid 1 is equipped with means enabling it to be locked onto the container body 3.

Said locking means are herein made up of four movable, hook-shaped struts 11, regularly distributed in the space between the main body 7 and the opposing skirt 8*b*.

Each of the locking hooks 11 is in the form of an elongated piece having two ends:

an upper end 11*a*, carried by a ring 12 (visible in FIG. 5), with a possibility of rotational movement about an axis 13 (perpendicular to the longitudinal axis 6 of the lid 5), and a lower end 11*b*, having an inwardly projecting portion (i.e., herein, directed towards the longitudinal axis 6), intended to fit into a housing of the container body 3 to ensure the locking of the lid 5.

Each of the hooks 11 also carries a pressing roller 14, mounted so as to rotate freely around an axis 14*a* parallel to axis of rotation 13 of the former and intended to reduce the frictions during the operation of the hooks 11.

Figure 5:
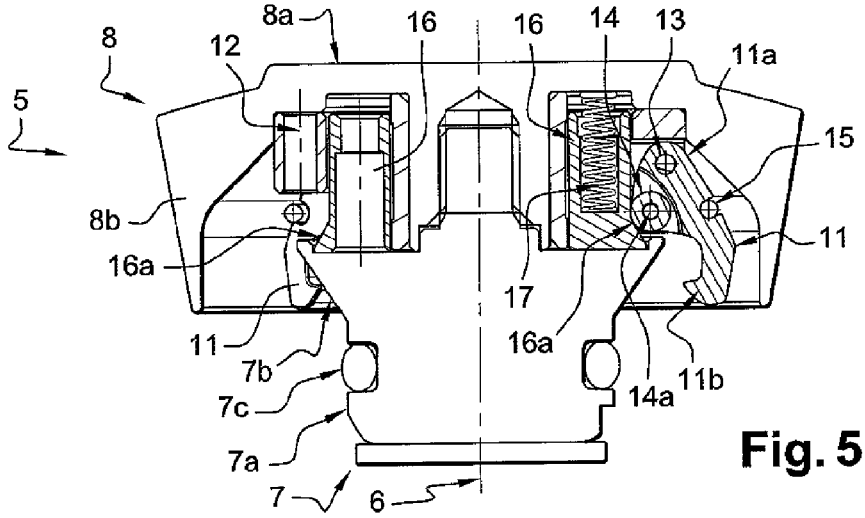
FIG. 5 is a broken sectional view along the cutting planes V-V of FIG. 4.

The locking hooks 11 are operable, around their axis of rotation 13, between two positions:

a locking position, corresponding to FIGS. 1 and 5, in which said hooks 11 are able to ensure the locking of the lid 5 onto the container body 3, and a retracted position, described in detail hereinafter with reference to FIG. 7, in which said hooks 11 are deactivated to enable the lid 5 to be separated from the container body 3.

Elastic return means 15 are connected to the hooks 11 to tend to keep the latter in the locking position.

The return means 15 are herein in the general form of an elastic ring.

The operation of the hooks 11 from the locking position to the retracted position is performed by displacement of a movable piece 16, called the "deactivation member", equipping the lid 5 and controllable by the operator.

Such deactivation member 16 has the general form of a ring having an outwardly flared lower edge 16*a* and on which the roller 14 of the hooks 11 is kept pressed by the action of the elastic return means 15 of the latter.

The lower edge 16*a* of the deactivation member 16 forms a cam for operating the hooks 11 between their locking and unlocking positions.

To this end, the deactivation member 16 is operable in an axial translational movement inside the lid 5, between two positions:

a lower, rest position (FIGS. 1 and 5), maintained by elastic return means 17, in which the rollers 14 of the hooks 11 cooperate with the small diameter of the lower edge 16*a* so that the hooks 11 are in the locking position, an upper, deactivation position (described in detail hereinafter with reference to FIG. 7), obtained by action of the operator, in which the great diameter portion of the lower edge 16*a* pushes the rollers 14 so as to make the hooks 11 pivot outwardly to the retracted position.

The elastic return means 17 can consist of spiral springs inserted in housings formed in the ring 16 and interposed between said ring and the lid head 8.

Moreover, still in FIG. 1, it can be seen that the lid 5 is locked onto a particular structure of the container body 3.

In this case, the upper edge 3*c* of the container 1 herein principally comprises an annular extension 20 having a generally triangular cross-section, with:

an outer inclined surface 20*a*, in which is formed an annular groove 21 opened outwardly and shaped so as to receive the lower end 11*b* of the hooks 11;

an inner inclined surface 20*b*, intended to conform the tapered part 7*b* of the closing lid 5.

The operations of locking and unlocking the closing lid 5 with respect to the container body 3 will now be described with reference to FIGS. 1, 6 and 7.

Figure 6:
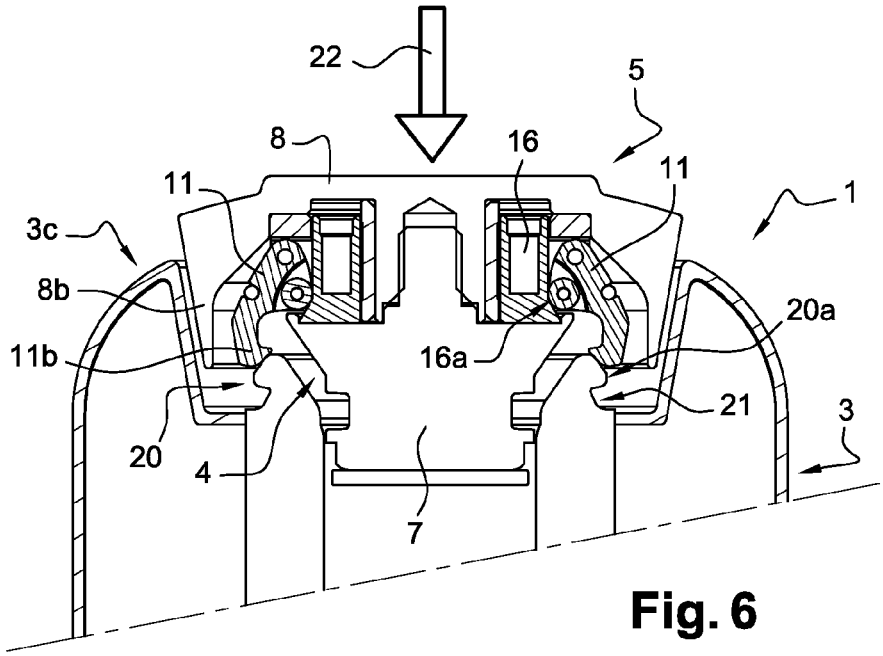
FIG. 6 is a partial flat cross-sectional schematic view of the container of FIG. 1, in which the lid is shown just before being locked onto the shielded body.

First, with reference to FIG. 6, the locking process consists in suitably positioning the closing lid 5 opposite the opening 4, so as it rests onto the upper edge 20.

In this situation preceding the locking operation, it can be seen that the hooks 11 are in the locking position (as above-described with reference to FIG. 5) and that the lower end 11*b* thereof rest onto the outer inclined surface 20*a* of the above-mentioned upper edge 20.

Then, the operator applies a vertical pressure along the axis of the opening 4, towards the base element 3*b* of the container body 3 (symbolized by the arrow 22 in FIG. 6).

As the lid 5 moves along inside the opening 4, the hooks 11 slide over the outer inclined surface 20*a*, which make them pivot outwardly. Then, the hooks 11 are automatically returned to their original position by the elastic return means 15, when their lower end 11*b* comes opposite the housing 21; this particular positioning displacement of the hooks 11 is a movement of the snap-action type.

The lid 5 is then suitably locked on the upper edge 3*c* of the container 3 and closes efficiently the opening 4 of the container body 3 (FIG. 1).

In this position, the main part 7 and the skirt 8*b* of the lid 5 are positioned on each side of the extension 20 of the body 3; a chicane-shaped nest of these two elements is thus obtained, which further contributes to optimize the radioprotective efficiency of the container 1.

To unlock the lid 5 (FIG. 7), the operator uses a magnetic-field-emitting added means 24, in the form of a magnetic handle for example, intended to permit controlling the above-described deactivation member 16 to its deactivation position.

To this end, in practice, the operator positions its magnetic handle 24 in contact with the surface of the lid 5.

Once the handle 24 positioned, the magnetic field it emits makes the deactivation member 16 move upwardly to its upper position called "deactivation position". Then, the lower edge 16*a* of the deactivation member 16 pushes the rollers 14 outwardly, which allows to make the associated hooks 11 move apart to the unlocking position. The magnetic handle 24, attached by magnetization to the lid 5, then enables the lid to be separated from to the container body 3.

Of course, when the handle 24 is separated from the lid 5, the deactivation member 16 is returned to its rest position by the elastic return means 17; the hooks 11 come back to the locking position under the action of the spring 15 associated thereto.

Thus, this container structure allows a simple, quick and efficient locking of the lid onto the container body.

Moreover, this container is interesting as far as the security is concerned, because the operator has to bring complementary means to be able to open the lid, which thus limits the risks of accidental opening.

Figure 7:
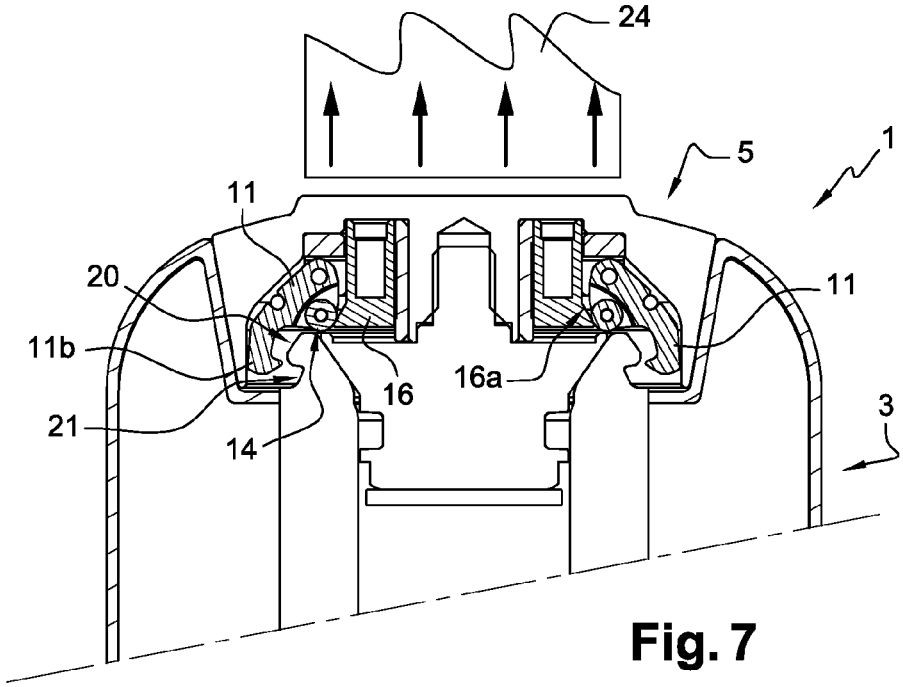
FIG. 7 is another partial cross-sectional view of the container according to FIGS. 1 and 6, in which the locking means of the closing lid are operated to the deactivated position by means of a magnetic handle, to enable said lid to be separated from the shielded body.

The particular structure of the container body 3 can also be seen in FIGS. 1, 6 and 7. This body 3 is made up of a tungsten inner part 29 nested into a lead outer part 30; these two shielded parts are each made up of a belt of side walls connected to a base element. Thus, the inner part 29, on the side of the radioactive source, is made of radioprotective material having radioprotective characteristics higher than those of the outer part 30, the thickness of these inner 29 and outer 30 parts being a function of the required level of radioprotection.

The two parts 29 and 30 are herein maintained together by means of two cylindrical through-inserts 33 made of tungsten; the outer free end 33*a* of these inserts also serves for the fixation of the two free ends of transportation handle 34 of the container 1, by suitable means.

The extension 20 of the container body, on which the closing lid 5 locks, is single-piece and constitutes a part of said tungsten lower part 29.

The locking of the hooks 11 onto this lower part 29 enables the wear and friction resistance characteristics thereof to be used; this locking also allows a continuity of the tungsten shield, which further optimizes the obtained quality of protection against radiation.

Moreover, it is to be noticed that the lead shielded part 30 comprises an upper extension which surrounds the outer surface of the lid skirt 8*b*.

To be complete, the body 3 further comprises a peripheral shell 31 made of a plastic material, covering the surface of the outer shielded part 30 thereof.

This plastic shell 31 is made up of a cylindrical wall 31*a*, the lower edge of which is connected to a base element 31*b* and the upper edge of which is extended by an upper return 31*c* covering the upper edge or the outer shielded part 30.

The base element 31*b* and the lower edge of the side wall 31*a* of the plastic shell 31 are provided with complementary structural means 32, of the grooves/ribs type, enabling them to be assembled by nesting (which is permanent or detachable).

Said possibility of detachment can prove useful to facilitate the replacement of the outer shell when wore or damaged.

Generally, this particular structure of the container body 3, combining a tungsten shield and a lead shield, can be used with a lid not having the above-mentioned particular locking means.

FIGS. 8 to 11 show another possible form of a container according to the invention, in which the closing lid is provided with locking means that can be deactivated by mechanical means, in this case a handle designed to this end.

This container 35 is similar to that above-described with reference to FIGS. 1 to 7.

The container body 3 is thus similar to that above-described.

As for the lid 36, it comprises the movable hooks 11, each carrying a roller 14 and operable by the deactivation member 16; the only difference of the lid 36 with respect to the above one is that it is provided with a hinged handle 37 enabling the mechanical operation of the deactivation member 16.

More precisely, the handle 37 supports a transversal pin 38 from which extend two vertical shafts 39 fixed to the deactivation member 16.

It is herein the operation of the handle 37 that allows the displacement of the deactivation member 16 and the movement of the hooks 11 between the locking and unlocking positions.

Figure 8:
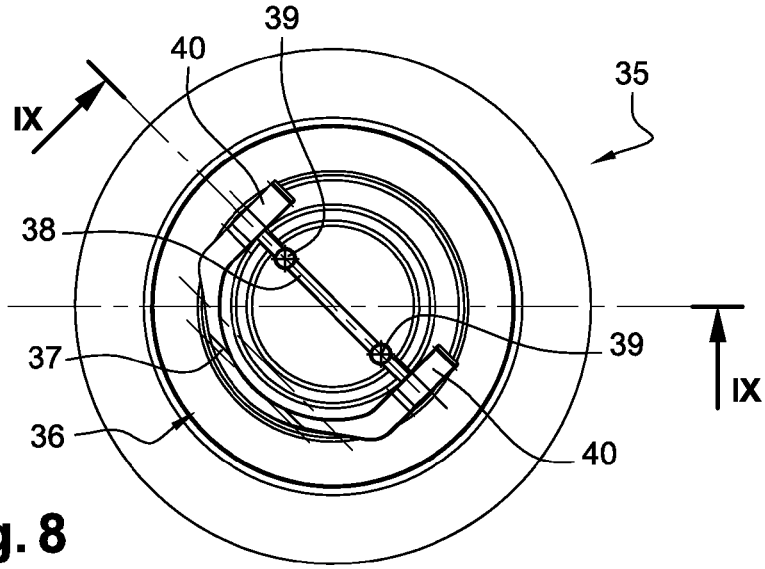
FIG. 8 is a top view of another possible form of container, the closing lid of which is provided with a handle for an operator to operate the locking means thereof.
Figure 9:
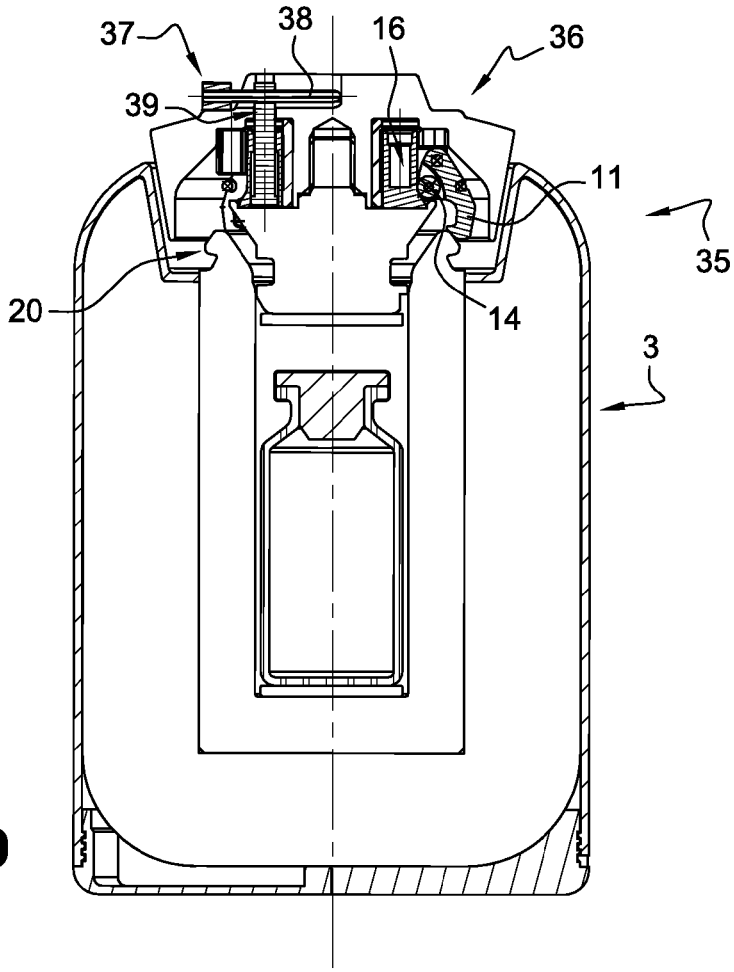
FIG. 9 is a broken sectional view of the container of FIG. 8, along the cutting planes IX-IX, and in which the closing lid is shown just before being locked onto the container body.

In practice, for closing the body 3, the handle 37 is pulled down onto the lid 36, which corresponds to the lower rest position of the deactivation member 16 and to the locking position of the hooks 11 (FIGS. 8 and 9).

Figure 10:
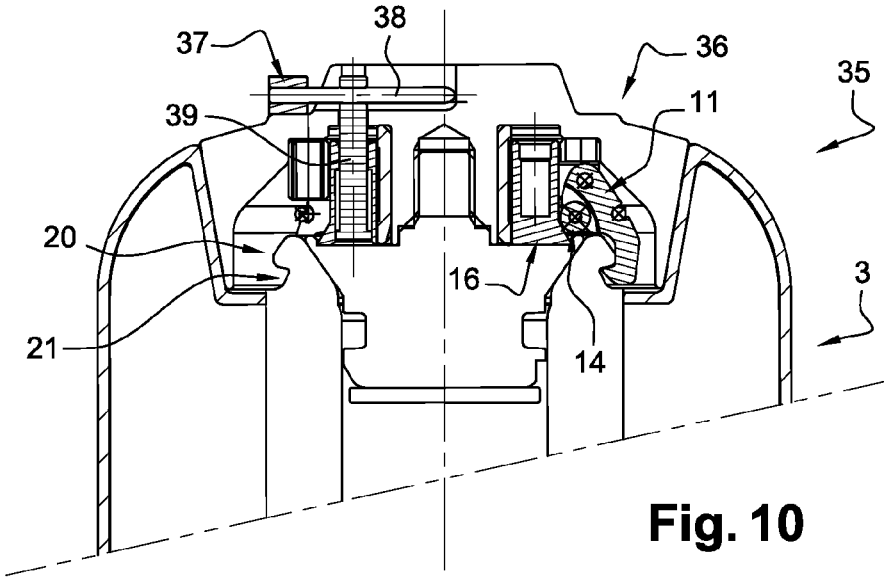
FIG. 10 is a partial view of the container of FIG. 9, in which the closing lid is locked onto the container body.

Then, the lid 36 is positioned opposite the opening 4 of the container body 3 (FIG. 9), and the operator pushes the lid 36 towards the base element 3*b* until the hooks 11 are snap-fitted into the housing 21 of the body 3 (FIG. 10). The lid 36 is thus suitably locked onto the body 3.

Figure 11:
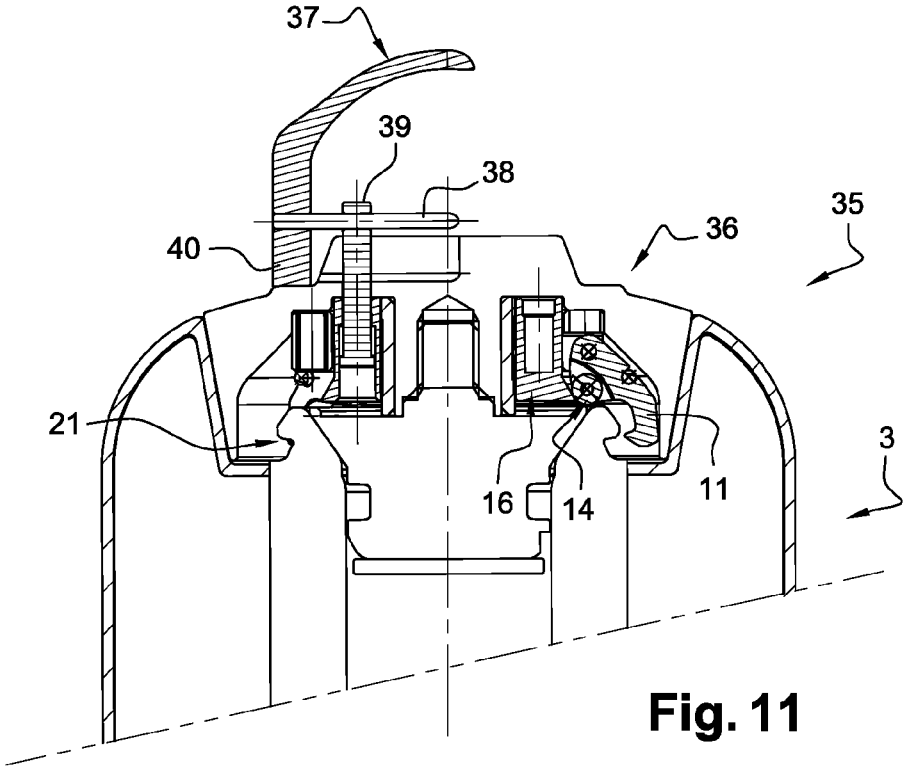
FIG. 11 is another partial view of the container of FIG. 9, in which the locking means are controlled to the retracted position by operation of the handle.

Conversely, to separate the lid 36 from the body 3, the operator just has to operate the handle 37 upwardly, such as illustrated in FIG. 11.

During this operation, the transversal axis 38 moves upward, by the leverage generated by the two side extensions 40 resting on the upper face of the lid 36, which implies an axial traction onto the vertical shafts 39, the latter ensuring a movement of the deactivation member 16 to the upper deactivation position thereof. Finally, the hooks 11 end up to the unlocking position and dissociate from the housing 21; the operator can then separate the lid 36 from the container body 3.

This latter embodiment has the advantage that it is relatively simple and do not necessitate the use of added means to unlock the lid 36.

The invention claimed is:

1. A container for transporting a receptacle (2) containing a radioactive substance for medical use, said container (1) comprising:

a body (3) shielded against the emission of radiation, made up of a belt of side walls (3*a*) connected to a base element (3*b*) and defining a top opening (4), and a shielded closing lid (5, 36) attachable to said top opening (4) by locking means (11), wherein, said locking means (11) are shaped so as to be activated by a translational movement (22) of said lid (5, 36) in said top opening (4), this being termed the "locking movement" and taking place along the axis of said opening (4) and towards said opposing base element (3*b*), said lid (5, 36) being further equipped with means (16) for deactivating said locking means (11) in order to enable said shielded lid (5, 36) to be separated from said container body (3), the lid (5, 36) has a plurality of retractable projecting studs (11) designed to fit by a snap-action type phenomenon into at least one complementary housing (21) formed in the opening (4) of the container body (3), said projecting studs (11) being operable between two positions:

a locking position, in which said projecting studs (11) enter said housing (21) by a snap-action type phenomenon during the locking translational movement, and a retracted position, actuated by the deactivation means (16) and in which said projecting studs (11) are located outside the bulk of said housing (21), enabling the shielded lid (5, 36) to be dissociated from the container body (3), said projecting studs (11) cooperate i) with spring means (15) shaped so as to tend to keep the projecting studs in the locking position, and ii) with the deactivation means (16) controllable by an operator to operate said projecting studs (11) to their retracted position, wherein the studs (11) are in the form of hooks hinged at one of their ends (11*a*), and the other end (11*b*) of which projects inwardly so as to be able to cooperate with an annular groove (21) opened outwardly and formed in the opening (4) of the container body, said projecting hooks (11) cooperating with the deactivation member (16), controllable by the operator, to make the former pivot outwardly to the retracted position, and wherein the deactivation member (16) is in the general form of a ring operable in an axial translational movement between the lower rest position and the upper deactivation position, said deactivation member (16) being provided with an outwardly flared lower edge (16*a*) to form the operating cam acting on the hooks (11) through pressing rollers (14), each of which is carried by one of said hooks (11), the latter being also connected to elastic return means (15), in the form of an elastic ring tending to keep them in the active locking position.

2. The shielded container according to claim 1, wherein the deactivation member (16) consists of one piece having an outwardly flared part (16*a*) forming a cam, said deactivation member (16) being movable inside the lid (5, 36), between two positions:

a rest position, in which the hooks (11) are in the locking position, and a deactivation position, obtained through an operator control action and in which said flared part (16*a*) pushes said hooks (11) so as to make them pivot outwardly to the retracted position.

3. The shielded container according to claim 2, wherein the lid (36) is equipped with a handle (37) whose operation ensures the displacement of the deactivation member (16) so as to control the displacement of the protruding members (11) between the retracted position and an un-retracted position.

4. The shielded container according to claim 2, wherein the deactivation member (16) is operable to the deactivation position, corresponding to a retracted position of the hooks (11), through application by the operator of a magnetic field generated by means of a magnetic handle (24) added on the lid (5).

5. The shielded container according to claim 1, wherein the lid (36) is equipped with a handle (37) whose operation ensures the displacement of the deactivation member (16) so as to control the displacement of the protruding members (11) between the retracted position and an un-retracted position.

6. The shielded container according to claim 5, wherein the deactivation member (16) is in the general form of a ring operable in an axial translational movement between the lower rest position and the upper deactivation position, said deactivation member (16) being provided with an outwardly flared lower edge (16*a*) to form the operating cam acting on the hooks (11) through pressing rollers (14), each of which is carried by one of said hooks (11), the latter being also connected to elastic return means (15), in the form of an elastic ring tending to keep them in the retracted position and an un-retracted position.

7. The shielded container according to claim 1, wherein the deactivation member (16) is operable to the deactivation position, corresponding to a retracted position of the hooks (11), through application by the operator of a magnetic field generated by means of a magnetic handle (24) added on the lid (5).

8. The shielded container according to claim 1, wherein the body (3) is made up of a shielded inner part (29) nested into an also-shielded outer part (30), said shielded parts (29, 30) being each made up of a belt of side walls connected to a base element, and said inner part (29), on the side of the radioactive source, is made of radioprotective material having radioprotective characteristics higher than those of said outer part (30), the thickness of these inner (29) and outer (30) parts being a function of the required level of radioprotection.

9. The shielded container according to claim 8, wherein the body (3) comprises a tungsten inner part (29) nested into a lead outer part (30), the closing lid (5, 36) locking onto said inner part (29).

10. The shielded container according to claim 9, wherein the body (3) also comprises a peripheral shell (31) made of a plastic material, covering the surface of the shielded outer part (30) thereof.

11. The shielded container according to claim 8, wherein the body (3) also comprises a peripheral shell (31) made of a plastic material, covering the surface of the shielded outer part (30) thereof.

12. The shielded container according to claim 11, wherein the plastic shell (31) is made up of a belt of side walls (31*a*), the edges of which are connected to a base element (31*b*) and to an upper return (31*c*) covering at least the upper edge of the shielded outer part (30), and said base element (31*b*) and the lower edge of the belt of side walls (31*a*) of the plastic shell (31) are provided with complementary structural means (32) enabling them to be assembled by permanent or detachable nesting.

13. The shielded container according to claim 1, wherein the lid (36) is equipped with a handle (37) whose operation ensures the displacement of the deactivation member (16) so as to control the displacement of the protruding members (11) between the retracted position and an un-retracted position.

14. The shielded container according to claim 1, wherein the deactivation member (16) is operable to the deactivation position, corresponding to a retracted position of the hooks (11), through application by the operator of a magnetic field generated by means of a magnetic handle (24) added on the lid (5).

15. The shielded container according to claim 1, wherein the body (3) is made up of a shielded inner part (29) nested into an also-shielded outer part (30), said shielded parts (29, 30) being each made up of a belt of side walls connected to a base element, and said inner part (29), on the side of the radioactive source, is made of radioprotective material having radioprotective characteristics higher than those of said outer part (30), the thickness of these inner (29) and outer (30) parts being a function of the required level of radioprotection.

16. A container for transporting a receptacle containing a radioactive substance for medical use, said container comprising:

a body shielded against emission of radiation, the body comprising a belt of side walls connected to a base element and defining a top opening, and a shielded closing lid attachable to said top opening by a locking part, said locking part activated by a translational movement of said lid in said top opening taking place along the axis of said opening and towards said base element, the lid comprising i) a deactivation member for deactivating said locking part to separate said shielded lid to from said container body, and ii) retractable projecting studs snap-action fitting into a complementary housing in the opening of the container body, said projecting studs operable between i) a locking position, in which said projecting studs enter said housing by the snap-action during the locking translational movement, and ii) a retracted position in which said projecting studs are located outside the bulk of said housing, wherein, said projecting studs cooperate i) with spring means tending to keep the projecting studs in the locking position, and ii) with the deactivation member controllable by an operator to operate said projecting studs to a retracted position, wherein, the studs comprise hinged hooks with one end projecting inwardly to cooperate with an annular groove opened outwardly and formed in the opening of the container body, said projecting hooks cooperating with the deactivation member to pivot outwardly to the retracted position, and the deactivation member comprises a ring operable in an axial translational movement between a lower rest position and an upper deactivation position, said deactivation member with an outwardly flared lower edge forming an operating cam acting on the hooks through pressing rollers carried by said hooks, the hooks being also connected to an elastic ring tending to keep the hooks in the active locking position.

* * * * *